US009928723B2

(12) United States Patent
Chen

(10) Patent No.: US 9,928,723 B2
(45) Date of Patent: Mar. 27, 2018

(54) MOISTURE DETECTION APPARATUS

(71) Applicant: Yongchuang Chen, Edmonton (CA)

(72) Inventor: Yongchuang Chen, Edmonton (CA)

( * ) Notice: Subject to any disclaimer, the term of this patent is extended or adjusted under 35 U.S.C. 154(b) by 52 days.

(21) Appl. No.: 14/686,829

(22) Filed: Apr. 15, 2015

(65) Prior Publication Data

US 2016/0307430 A1 Oct. 20, 2016

(51) Int. Cl.
*G08B 21/20* (2006.01)
*G08B 6/00* (2006.01)

(52) U.S. Cl.
CPC ..... *G08B 21/20* (2013.01); *G08B 6/00* (2013.01)

(58) Field of Classification Search
CPC .. G01N 33/246; G01N 27/223; G01N 27/121; G08B 21/20
See application file for complete search history.

(56) References Cited

U.S. PATENT DOCUMENTS 4,356,818 A 11/1982 Macias et al.
5,459,452 A 10/1995 DePonte
5,903,222 A * 5/1999 Kawarizadeh ..... G01N 27/223 128/886
5,959,535 A 9/1999 Remsburg
8,381,575 B2 2/2013 Seo
2004/0147888 A1* 7/2004 Huang ..... A61F 13/42 604/361
2005/0195085 A1* 9/2005 Cretu-Petra ..... A61B 5/6808 340/573.5
2008/0074274 A1 3/2008 Hu et al.
2008/0266117 A1 10/2008 Song et al.
2014/0121473 A1 5/2014 Banet et al.
2014/0333441 A1 11/2014 Solazzo et al.

FOREIGN PATENT DOCUMENTS

CA 2374054 A1 1/2001
CA 2842459 A1 1/2013
CA 2844826 A1 2/2013
EP 2014267 A1 1/2009
KR 20040027806 3/2004

* cited by examiner

*Primary Examiner* — Curtis Odom

(57) ABSTRACT

A moisture detection apparatus can include a soft printed circuit board, a power supply, a processing unit, and a bendable body. The soft printed circuit board can include at least one capacitor. The power supply can be arranged to apply a voltage across the at least one capacitor. The processing unit can have one or more processors configured to detect a capacitance across the at least one capacitor and emit a moisture detection signal in response to a change the capacitance across the at least one capacitor. The soft printed circuit board is embedded in the bendable body. A kit can be comprised of the moisture detection and at least one bag assembly. Another kit can be comprised of the moisture detection and a receiving unit configured to receive the moisture detection signal.

18 Claims, 7 Drawing Sheets

MOISTURE DETECTION APPARATUS

BACKGROUND

1. Field

The present disclosure relates to a moisture or wetness sensing device for diapers and other undergarments to enable the prompt changing of the same when they become wet.

2. Description of Related Prior Art

U.S. Pat. No. 5,903,222 discloses a wet garment detector. The garment diaper detector for detecting wetness conditions in diapers or undergarments comprises a capacitive sensor located within a housing and affixed to the exterior surface of the garment being monitored. The sensor is comprised of two substantially solid, coplanar conductor plates affixed to a common substrate and has a very high dynamic range. When the inside of the garment becomes wet, the capacitance between the spaced conductors rises above a predetermined value whereupon the detector provides an output to a transmitter or an alarm. When the garment is being changed, the detector is removed from the exterior surface of the garment for reuse on the next. In one embodiment of the invention, multiple, uniquely addressed wetness detectors are employed to monitor the wetness conditions in a plurality of garments, such as in a hospital or nursing home. When a garment becomes wet, that unique address is transmitted to a central monitoring station which dispatches a care giver to change the garment. Additionally, the central monitoring station may be equipped with a modem which communicates the address of wet garments to pagers worn by care givers.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A moisture detection apparatus can include a soft printed circuit board, a power supply, a processing unit, and a bendable body. The soft printed circuit board can include at least one capacitor. The power supply can be arranged to apply a voltage across the at least one capacitor. The processing unit can have one or more processors configured to detect a capacitance across the at least one capacitor and emit a moisture detection signal in response to a change the capacitance across the at least one capacitor. The soft printed circuit board is embedded in the bendable body. A kit can be comprised of the moisture detection and at least one bag assembly. Another kit can be comprised of the moisture detection and a receiving unit configured to receive the moisture detection signal.

BRIEF DESCRIPTION OF THE DRAWINGS

The detailed description set forth below references the following drawings.

DETAILED DESCRIPTION

The present disclosure, as demonstrated by the exemplary embodiment described below, can provide a diaper alarm. When the diaper is wet, a moisture detection apparatus can send signal to a computing device wirelessly. A moisture detection apparatus can detect if the diaper is wet by a capacitive sensor. A capacitive sensor can be applied to detect moisture without directly contacting the moisture. The capacitive sensor of the moisture detection apparatus can be positioned on the outside of the diaper. Hook and loop fasteners or a bag assembly can be adhered to the diaper to hold the sensor. A body of the moisture detection apparatus can be made of silicone and so be soft and bendable; the sensor can be embedded in the body. Other sensors could be included in the moisture detection apparatus, such as a temperature probe or acceleration sensor to provide more information to the caretaker, such as monitoring baby that is sleeping or moving. One or more embodiments of the present disclosure could also be applied as a bed wetting alarm, a potty training tool, a tool to help cure enuresis, a baby monitor, and a device to help individuals who cannot care for themselves.

A moisture detection apparatus 10 can be positioned next to a garment and detect if the garment becomes wet. The moisture detection apparatus 10 can be positioned next to any kind of garment, including under-clothing and diapers. Upon detection that the garment is moist, moisture detection apparatus 10 can emit an electronic signal that can be applied to generate a warning to another person, such as a caregiver.

Figure 1:
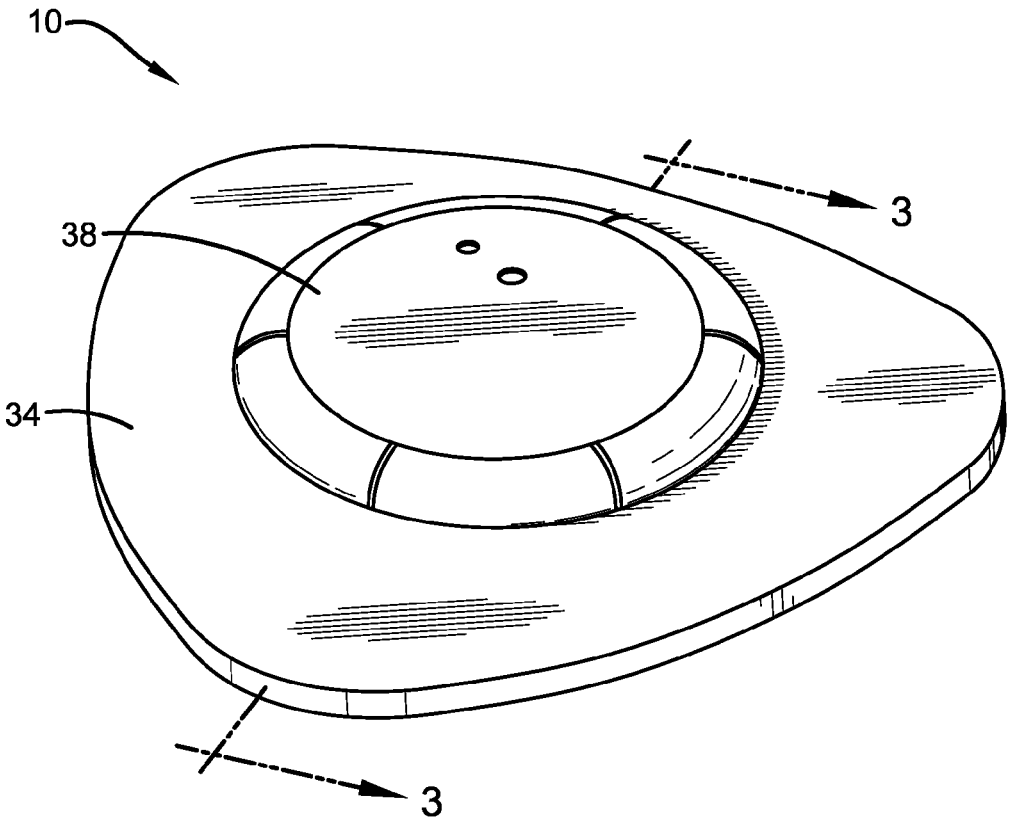
FIG. 1 is a perspective view of an exemplary embodiment of a moisture detection apparatus according to the present disclosure.
Figure 2:
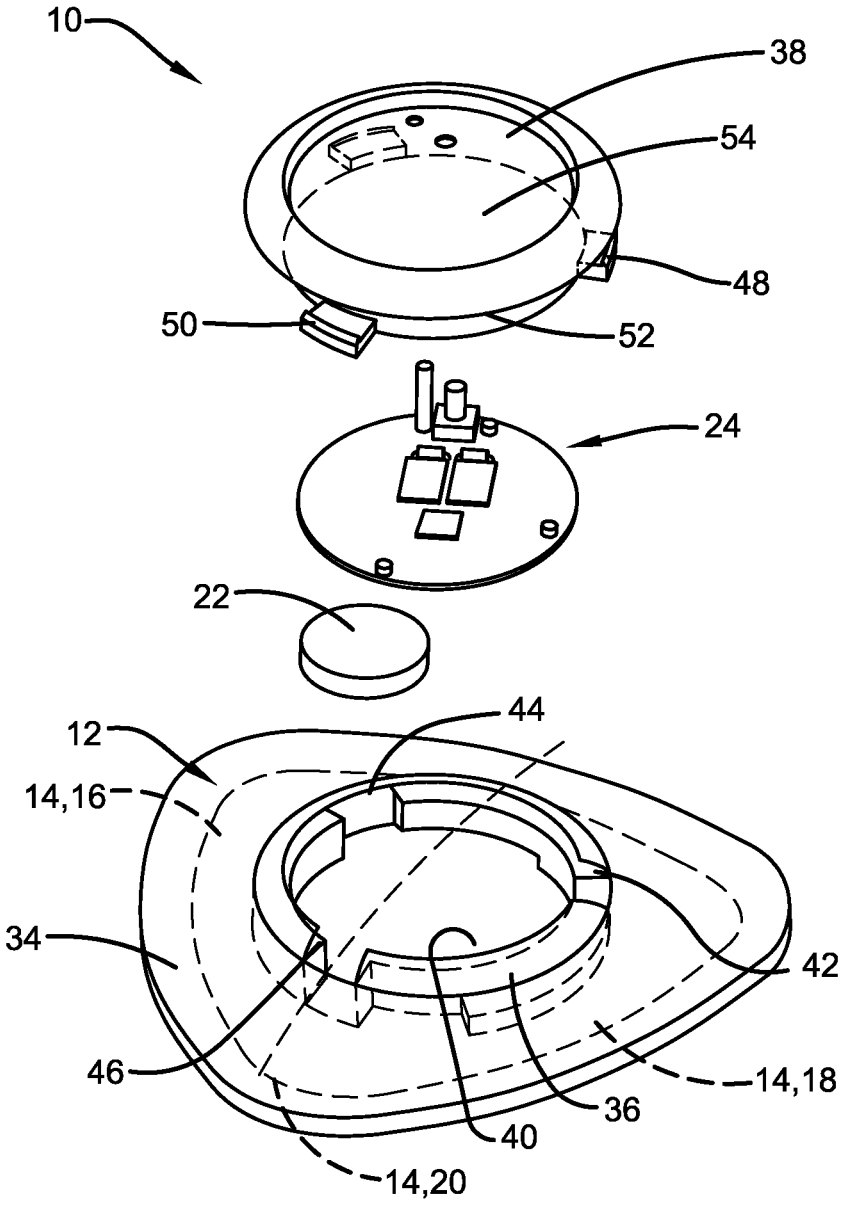
FIG. 2 is an exploded view of the exemplary moisture detection apparatus.

The moisture detection apparatus 10 can include a soft printed circuit board 12, shown in phantom in FIG. 2. The soft printed circuit board 12 can include at least one capacitor 14. The capacitor 14 acts as a capacitive sensor. The capacitor 14 can have two conductive plates 16, 18 existing on substantially the same flexible surface together and have sufficient surface area provide adequate sensitivity to the presence of conductive materials, such as moisture. A line referenced at 20 can be the location of the gap between the plates 16, 18. The capacitor plates 16, 18 that make up the capacitive sensor can be flexible in order to conform to a desired shape, such as the outer profile of an occupied diaper. The at least one capacitor 14 can thus define an arcuate profile. The closer the plates 16, 18 throughout the plate area to the diaper, the more sensitive the capacitance will be to moisture. Said in a different manner, the closer the plates 16, 18 are the smaller the plate area can be in order to remain effective at detecting moisture. The plate shape can be varied. The plates 16, 18 can be of similar area. However, the respective areas do not have to be exactly the same, but since the two plates 16, 18 each form their own capacitance with the moisture they are effectively in series and therefore having similar capacitance keeps the overall capacitance higher and more conducive to measurement.

The moisture detection apparatus 10 can also include a power supply 22 arranged to apply a voltage across the at least one capacitor 14. The power supply 22 can be a battery. The power supply 22 could be removable and replaceable. The power supply 22 could be rechargeable or non-rechargeable. The power supply 22 life can be improved by taking applying voltage once every few seconds instead of constantly. In the same manner, other components drawing power from the power supply 22 could be used to intermittently since such draws potentially represent significant power draws.

Figure 3:
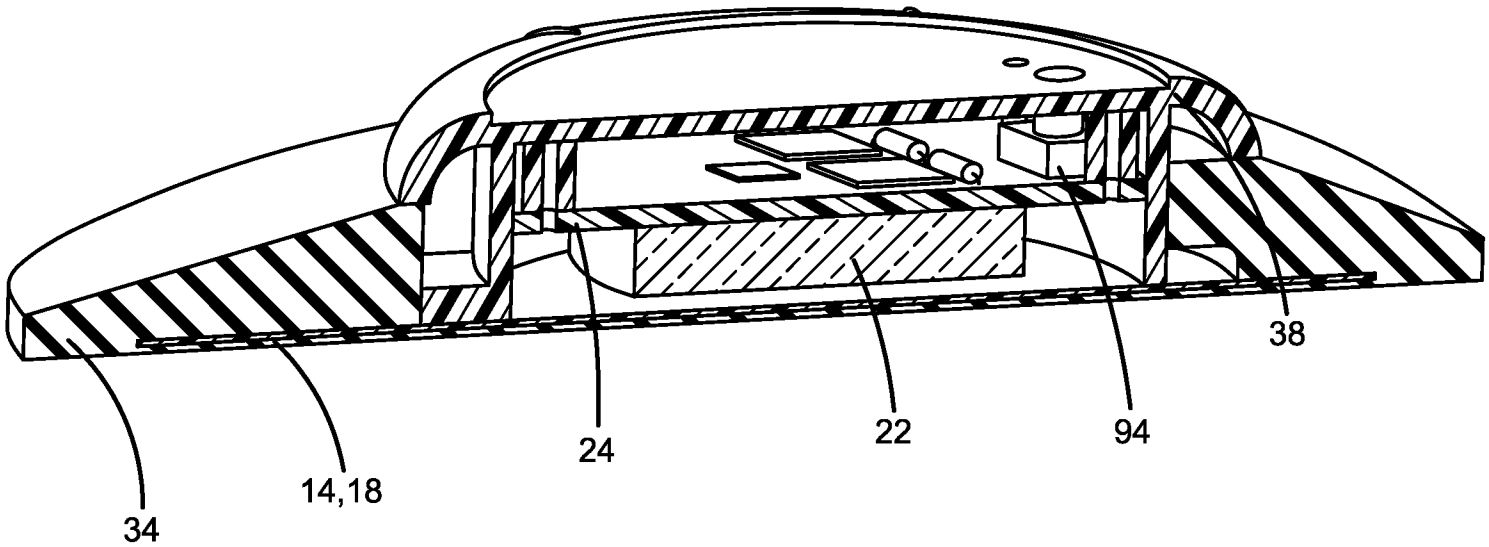
FIG. 3 is a cross-section through the exemplary moisture detection apparatus along section lines 3-3 in FIG. 1.
Figure 5:
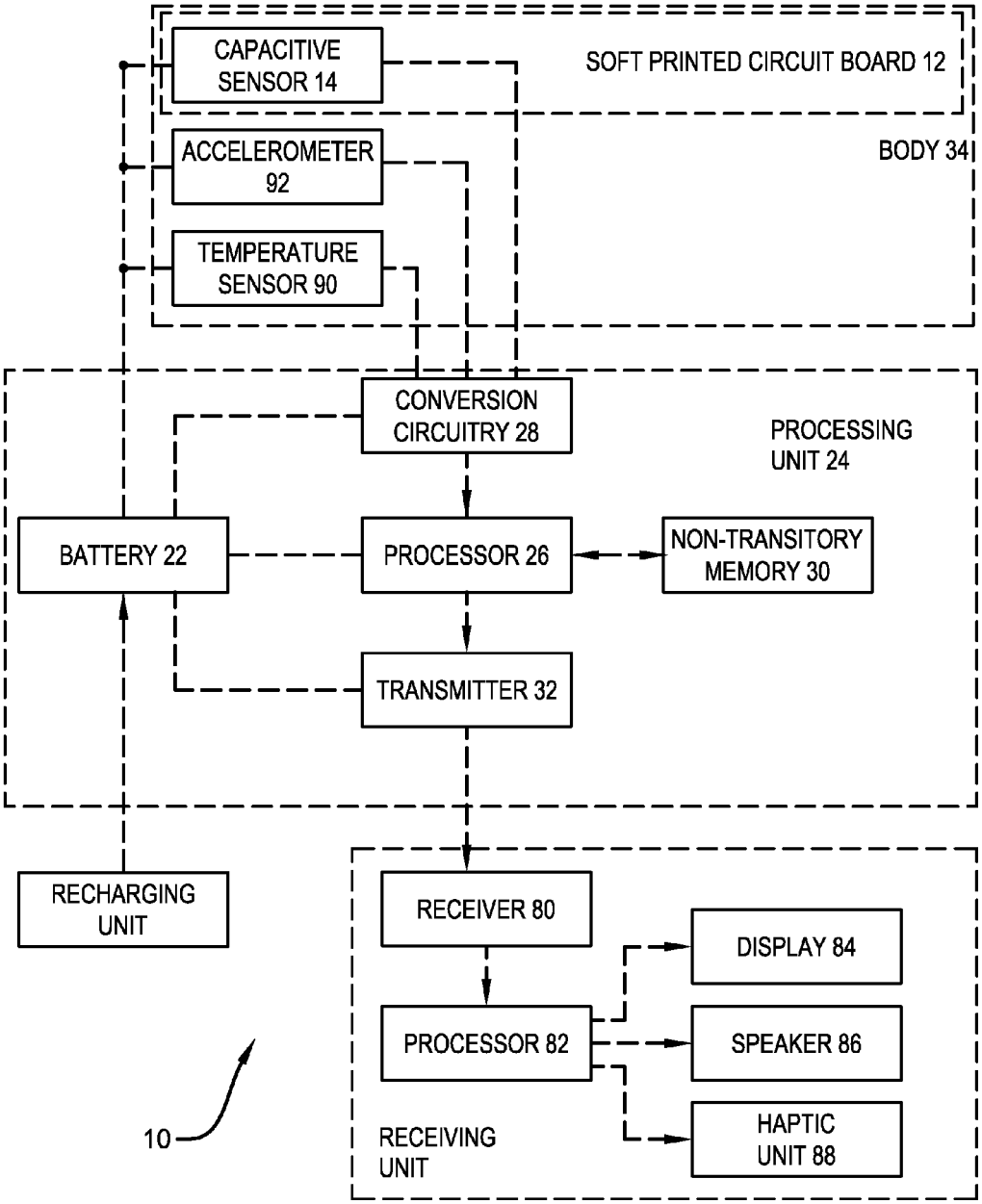
FIG. 5 is a schematic view of an exemplary moisture detection apparatus.

The moisture detection apparatus 10 can also include a processing unit 24 having one or more processors, such as processor 26. The power supply 22 can be mounted on the processing unit 24. The exemplary processing unit 24 can also include inputs and outputs. The processing unit 24 can be configured to detect a capacitance across the at least one capacitor 14 and emit a moisture detection signal in response to a change the capacitance across the at least one capacitor 14. As best shown in FIG. 5, the exemplary processing unit 24 can also include conversion circuitry 28 for converting the capacitance (such as a change in capacitance) into a signal that can be processed by the processor 26. The conversion circuitry could operate as a capacitance to frequency (or pulse-width) converter. The exemplary processing unit 24 can also include non-transitory memory 30 containing a program for processing the signal received from the capacitor 14. In response to a change in the capacitance across the capacitor 14 (indicative of the presence of moisture in the garment), the processor 26 can generate a detection signal. The exemplary processing unit 24 can also include a transmitter 32. The processor 26 can direct the detection signal to the transmitter 32 and the transmitter 32 can be operable to wirelessly transmit the detection signal remote from the apparatus 10. The transmitter 32 can be operable to wirelessly transmit in Zigbee, RF, Bluetooth, Z-wave, GSM, CDMA, WiFi, or WiMAX. As shown in FIG. 3, a button or LED 94 can be mounted on the processing unit. A button could be used to reset or activate the moisture detection apparatus 10. An LED could be used to indicate that the moisture detection apparatus 10 is activated.

Figure 6:
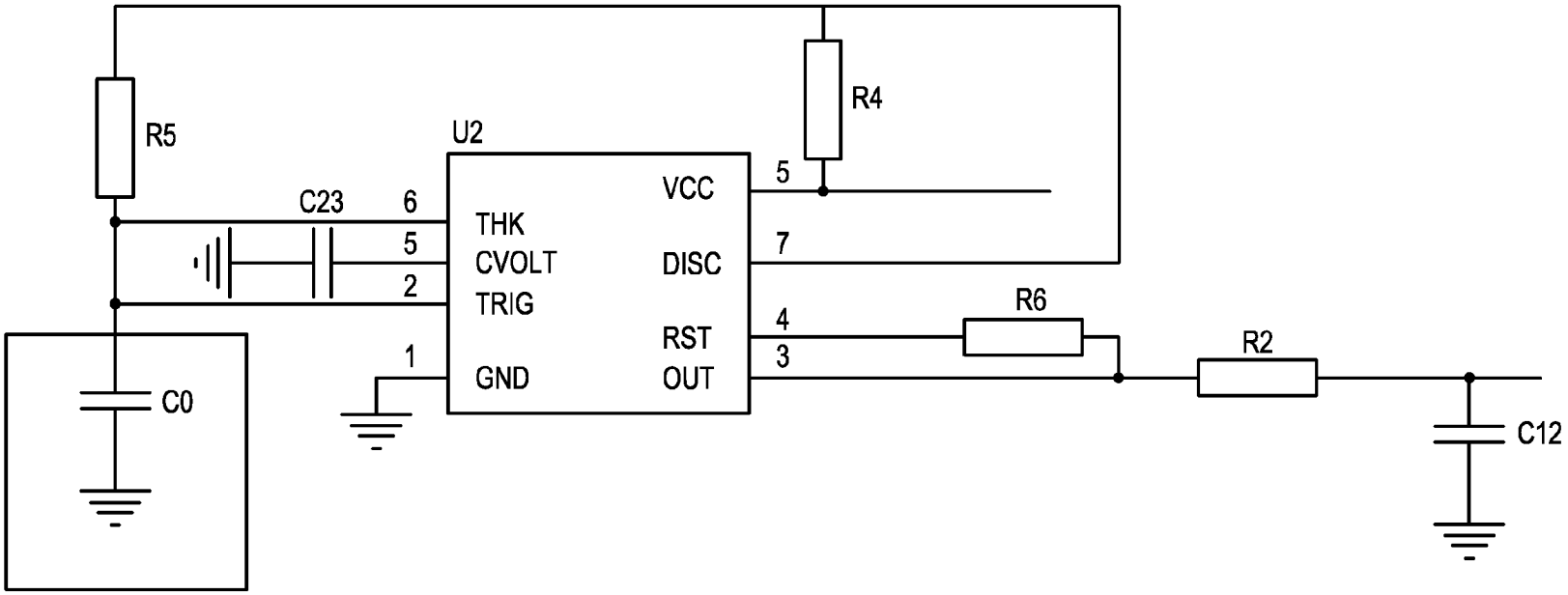
FIG. 6 is a circuit schematic for an exemplary embodiment of a moisture detection apparatus according to the present disclosure.

U.S. Pat. No. 5,903,222 is incorporated by reference in its entirety as an example of circuitry and operations that can be applied in one or more embodiments of the present disclosure. FIG. 6 is another exemplary circuit that can be applied in one or more embodiments of the present disclosure. U2 can be an integrated circuit composed of a basic R-S trigger voltage divider, a comparator, a discharge triode, and other parts. By way of example and not limitation, the circuit can be a multi-vibrator circuit based on the 555 timer IC. The circuit operates as a capacitance to frequency (or pulse-width) converter. The frequency of the square wave or the pulse-width can be measured by the microcontroller.

The moisture detection apparatus 10 can also include a bendable body 34. The soft printed circuit board 12 is embedded in the bendable body 34. The body 34 can be formed from silicone. Alternatively, the body 34 could be formed from rubber or other materials that provide some rigidity but are bendable. The body 34 can be deformed and elastically recover. The body 34 can define an arcuate profile in an unbent or static condition, conforming to the shape of part of the human body covered by a garment. The body 34 could be made in any shape, such as an animal like a bird or bear, or a cartoon character. A button operable to communicate with the processing unit 24 could be mounted in the body 34.

The moisture detection apparatus 10 can also include a first housing member 36 and a second housing member 38. The second housing member 38 can be fixed with respect to the body 34 and releasibly engageable with the first housing member 36 to define a cavity. The exemplary first housing member 36 is integrally-formed with respect to the body 34. "Integrally-formed" refers to the fact that in the exemplary embodiment the body 34 and the first housing member 36 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

The processing unit 24 and the power supply 22 are containable in the cavity when the first housing member 36 and the second housing member 38 are engaged with one another. The first housing member 36 can define an aperture 40 and a plurality of grooves 42, 44, 46 disposed about the aperture 40. Each of the plurality of grooves 42, 44, 46 is configured to receive respective portions (such as portions 48, 50) of the second housing member 38. The first housing member 36 and the second housing member 38 can then be rotated with respect to one another to engage each other. The second housing member 38 can be unbendable to provide more rigidity for protecting the processing unit 24 from damage. The second housing member 38 can include an annular wall 52 and a cap 54. The processing unit 24 can be positionable within the second housing member 38, surrounded by the wall 52 and the aperture 40 and captured by the cap 54. An LED could be mounted in the second housing member 38.

The processing unit 24 and the body 34 can be releasibly engageable with one another. The exemplary processing unit 24 can be disposed in electronic communication with the capacitor 14 to detect the capacitance across the at least one capacitor 14 when engaged with the body 34 and can be disposed out of electronic communication with the capacitor 14 when released from the body 34. By way of example and not limitation, the processing unit 24 can be released from the body 34 (and separated from the soft printed circuit board 12 and capacitor 14) when the power supply 22 is replaced or when the body 34 is replaced with another body.

Figure 4:
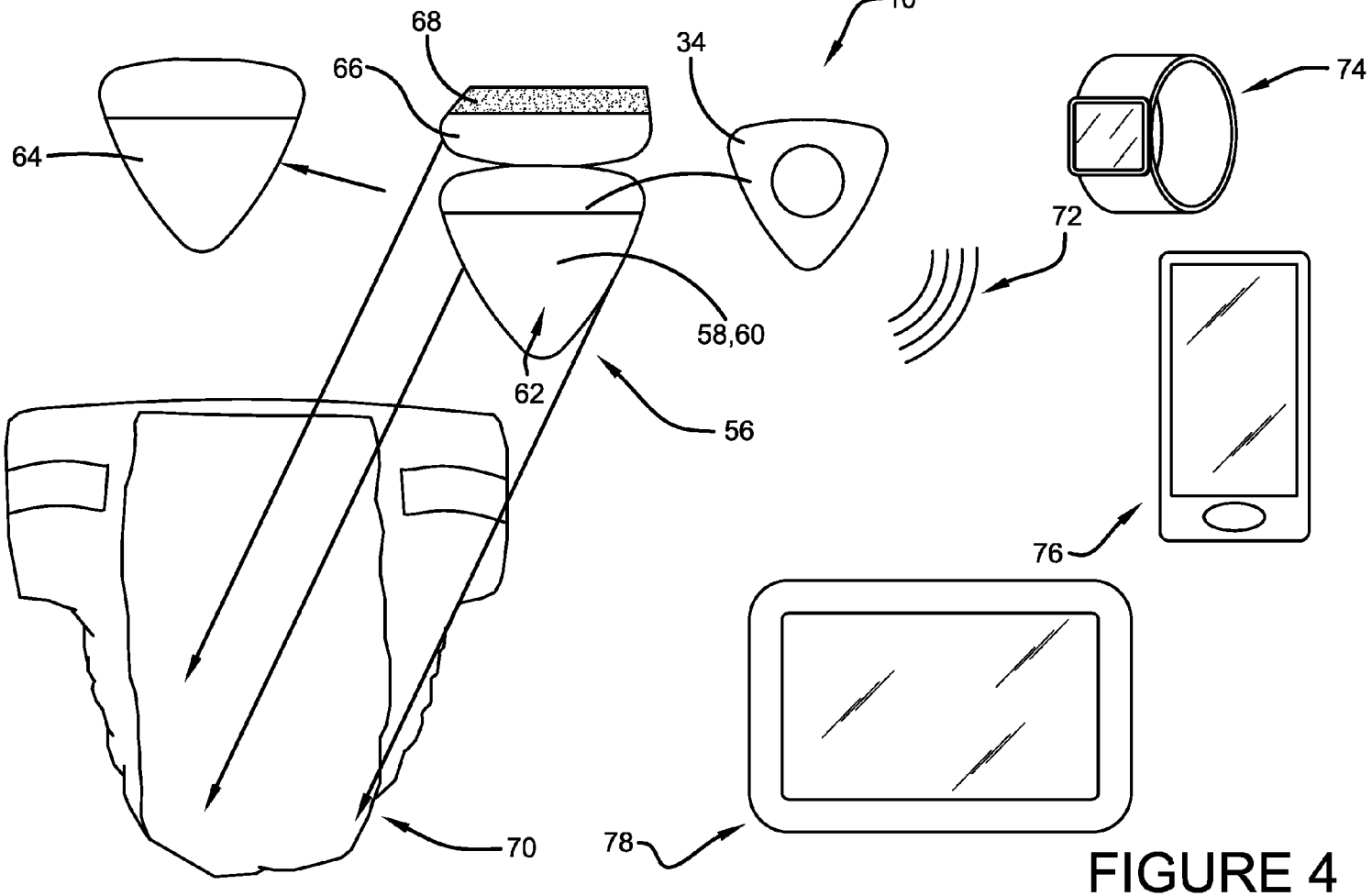
FIG. 4 is an exploded view of an exemplary operating environment of the exemplary moisture detection apparatus.

As best shown in FIG. 4, the moisture detection apparatus 10 can be part of kit also including at least one bag assembly 56. The bag assembly 56 can include a bag 58 having an outer surface 60, a quantity of adhesive 62 covering at least part of the outer surface 60, and a sheet 64 releasibly covering the quantity of adhesive 62. The quantity of adhesive 62 is positioned on an underside of the bag 68 in FIG. 4. The bag 58 can be sized to receive the moisture detection apparatus 10. The bag 68 can be transparent. The bag 58 can include a flap 66 with a second quantity of adhesive 68. Removable coverings, such as of wax paper for example, can cover the quantities of adhesive 62, 68 prior to use of the bag 68. After the moisture detection apparatus 10 has been placed in the bag 58, the flap 66 can be folded over and affixed to the bag 58 through the second quantity of adhesive 68 to seal the apparatus 10 in the bag 58. A child could not open the bag 58 after the bag 58 has been closed and sealed. The bag assembly 56 can be stuck on (attached to) baby "onesies," rompers, or underwear, as long as it is at the right position against the diaper. The bag assembly 56 could be made on diaper directly by the diaper manufacturer.

The bag 58 can be mounted to a garment 70 by removing the sheet 64 and exposing the quantity of adhesive 62. The portion of the outer surface 60 bearing the quantity of adhesive 62 can be pressed against a garment 70 to mount the moisture detection apparatus 10 (contained in the bag 58) to the garment 70. The moisture detection apparatus 10 is thus positioned to monitor the garment 70 for moisture. After use, the apparatus 10 can be removed from the bag 58 and used again in another bag 58. A kit can include a plurality of bag 58 assemblies. A kit could also include a second, replacement soft printed circuit board 12 including at least one capacitor 14 embedded in a second bendable body 34.

Figure 7:
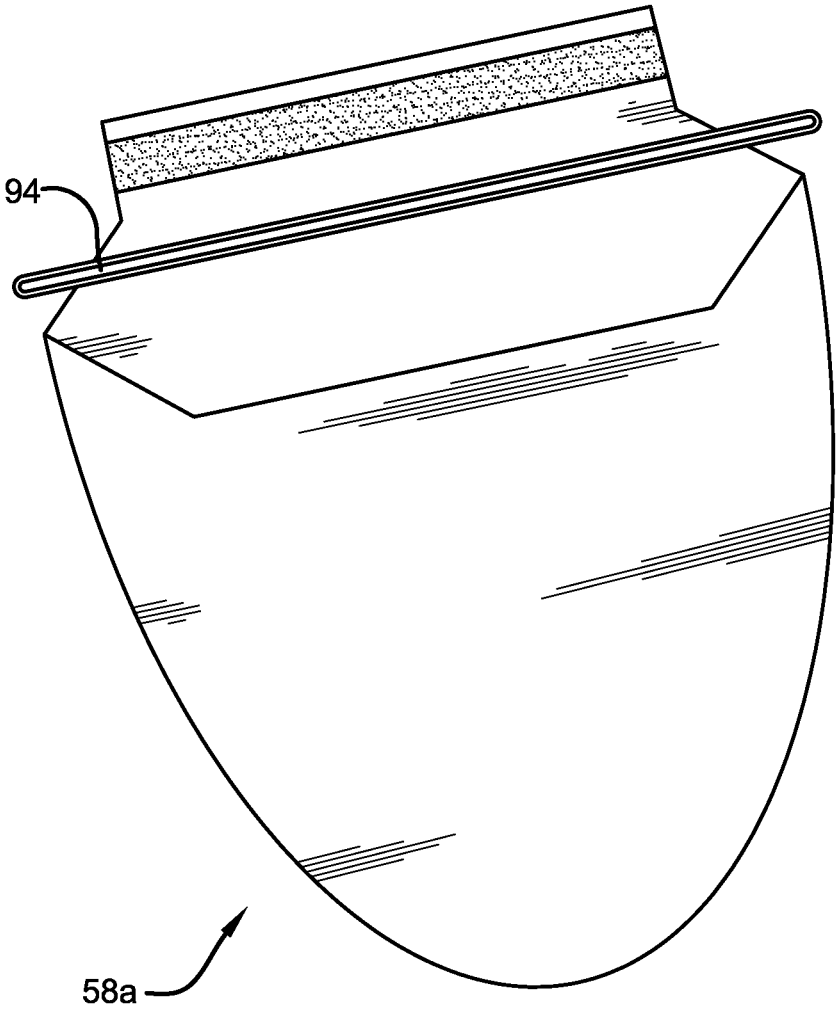
FIG. 7 is a perspective view of an alternative bag for use in one or more embodiments of the present disclosure.

FIG. 7 shows an alternative structure 58*a* for holding the apparatus 10. The structure 58*a* can be bag-like or envelop-like. The structure 58*a* can include a tear line 94 that can be pulled to open the structure 58*a* after the structure 58*a* has been closed.

As also shown in FIG. 4, the moisture detection apparatus 10 can be part of kit also including a receiving unit configured to receive the moisture detection signal (referenced at 72). FIG. 4 shows three alternative receiving units: a smart watch 74, a smartphone 76, and a tablet computer 78. The receiving unit can be operating an app. As shown in FIG. 5, the receiving unit can include a receiver 80 that can be operable to receive the moisture detection signal 72. The receiver 80 can direct the moisture detection signal 72 to a processor 82 of the receiving unit. The processor 82 can generate a moisture detection message in response to receiving the moisture detection signal 72. The message can be directed to a visual display 84. For example, the visual display 84 can display a text and/or graphical message communicating that the garment is wet. Alternatively, the message can be directed to a speaker 86. For example, the speaker 86 can emit an audio message communicating that the garment is wet. Alternatively, the message can be directed to a haptic unit 88. For example, the haptic unit 88 can vibrate to communicate that the garment is wet.

In one or more embodiments of the present disclosure, the moisture detection apparatus 10 can also include a temperature sensor 90 operable to detect a temperature and emit a temperature signal. The processing unit 24 can be operable to receive the temperature signal and emit a temperature detection signal in response to receiving the temperature signal. The detected temperature can be displayed on the display 84. In one or more embodiments of the present disclosure, the moisture detection apparatus 10 can also include an accelerometer 92 operable to detect movement and emit a movement signal. The processing unit 24 can be operable to receive the movement signal and emit a movement detection signal in response to receiving the movement signal. The detection of movement can be communicated over the display 84, the speaker 86, or the haptic unit 88.

In one or more embodiments, when a diaper is wet, a moisture detection apparatus can send a signal wirelessly. A transmitter of the apparatus can apply Bluetooth® standards for exchanging data over short distances by using short-wavelength radio transmissions, and thus creating personal area network (PAN). The transmitter can also apply 3G or 4G, which is defined by the International Mobile Telecommunications-2000 (IMT-2000) specifications promulgated by the International Telecommunication Union. The signal can be transmitted to a smartphone or a other device over a local area network. All the devices on the network could receive the signal (representing an alarm that the diaper is wet). In one or more embodiments including other sensors, such as an acceleration sensor, potentially a large volume of data could be transmitted. Such volumes of data may be too large for a smartphone. Thus, in one or more embodiments, the signal may be transmitted to a remote server for cloud computing. The output of such computing can be transmitted back to a smart phone proximate to the apparatus.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. A moisture detection apparatus comprising:

a soft printed circuit board including at least one capacitor;

a power supply arranged to apply a voltage across said at least one capacitor;

a processing unit having one or more processors configured to detect a capacitance across said at least one capacitor and emit a moisture detection signal in response to a change the capacitance across said at least one capacitor;

a bendable body, wherein said soft printed circuit board is embedded in said bendable body;

wherein said processing unit and said body are releasibly engageable with one another; and wherein said processing unit is disposed in electronic communication with said capacitor to detect the capacitance across said at least one capacitor when engaged with said body and is disposed out of electronic communication with said capacitor to detect the capacitance across said at least one capacitor when released from said body.

2. A moisture detection apparatus comprising:

a soft printed circuit board including at least one capacitor;

a power supply arranged to apply a voltage across said at least one capacitor;

a processing unit having one or more processors configured to detect a capacitance across said at least one capacitor and emit a moisture detection signal in response to a change the capacitance across said at least one capacitor;

a bendable body, wherein said soft printed circuit board is embedded in said bendable body;

a first housing member; and a second housing member fixed with respect to said body and releasibly engageable with said first housing member to define a cavity, wherein said processing unit and said power supply are containable in said cavity when said first housing member and said second housing member are engaged with one another.

3. The moisture detection apparatus of claim 2 wherein said body is formed from silicone.

4. The moisture detection apparatus of claim 2 wherein said body defines an arcuate profile.

5. The moisture detection apparatus of claim 4 wherein said at least one capacitor defines an arcuate profile.

6. The moisture detection apparatus of claim 2 wherein said processing unit and said body are releasibly engageable with one another.

7. The moisture detection apparatus of claim 6 wherein said power supply is mounted on said processing unit.

8. The moisture detection apparatus of claim 2 wherein said first housing member is integrally-formed with respect to said body.

9. The moisture detection apparatus of claim 8 wherein said first housing member defines an aperture and a plurality of grooves disposed about said aperture, wherein each of said plurality of grooves is configured to receive respective portions of said second housing member.

10. The moisture detection apparatus of claim 9 wherein said first housing member and said second housing member are rotated with respect to one another to engage each other.

11. The moisture detection apparatus of claim 2 wherein said second housing member is unbendable and includes an annular wall and a cap, said processing unit positionable within said second housing member.

12. The moisture detection apparatus of claim 2 wherein said processing unit further comprises:

a transmitter operable to wirelessly transmit the detection signal.

13. The moisture detection apparatus of claim 2 further comprising:

a temperature sensor operable to detect a temperature and emit a temperature signal, wherein said processing unit is operable to receive the temperature signal and emit a temperature detection signal in response to receiving the temperature signal.

14. The moisture detection apparatus of claim 2 further comprising:

an accelerometer operable to detect movement and emit a movement signal, wherein said processing unit is operable to receive the movement signal and emit a movement detection signal in response to receiving the movement signal.

15. The moisture detection apparatus of claim 2 wherein said power supply is a rechargeable battery or a non-rechargeable battery.

16. A kit comprising:

a moisture detection apparatus including a soft printed circuit board including at least one capacitor, a power supply arranged to apply a voltage across said at least one capacitor, a processing unit having one or more processors configured to detect a capacitance across said at least one capacitor and emit a moisture detection signal in response to a change the capacitance across said at least one capacitor, a bendable body wherein said soft printed circuit board is embedded in said bendable body; and at least one bag assembly include a bag having an outer surface, a quantity of adhesive covering at least part of said outer surface, and a sheet releasibly covering said quantity of adhesive, wherein said moisture detection apparatus is positionable in said bag, wherein said sheet is removable to expose said quantity of adhesive, and said adhesive is configured to bind said bag to a garment.

17. The kit of claim 16 wherein said at least one bag assembly is further defined as a plurality of bag assemblies.

18. The kit of claim 16 further comprising:

a second soft printed circuit board including at least one capacitor; and a second bendable body wherein said second soft printed circuit board is embedded in said bendable body, wherein said bendable body and said second bendable body are interchangeable with respect to said processing unit.

* * * * *